US005906548A

United States Patent [19]

Hadge

[11] Patent Number: 5,906,548

[45] Date of Patent: May 25, 1999

[54] CONVERTIBLE GOLF CLUB

[76] Inventor: Robert Hadge, 2811 Village Blvd., No. 203, West Palm Beach, Fla. 33409

[21] Appl. No.: 09/110,786

[22] Filed: Jul. 6, 1998

[51] Int. Cl.[6] ..... A63B 69/36; A63B 53/14

[52] U.S. Cl. ..... 473/206; 473/288; 473/296; 473/298; 473/299; 473/300

[58] Field of Search ..... 473/206, 288, 473/298, 296, 299, 300

[56] References Cited

U.S. PATENT DOCUMENTS 1,565,076 12/1925 Fink ..... 473/299 X 2,459,996 1/1949 Duncan ..... 473/298

3,837,647 9/1974 Jacques ..... 473/300

5,163,685 11/1992 Rhodes ..... 473/206

*Primary Examiner*—George J. Marlo

*Attorney, Agent, or Firm*—McHale & Slavin, PA

[57] ABSTRACT

A convertible golf club comprises an elongated shaft having a club head at a distal end and an overgrip at a proximal end. Removable hand guides are secured to the overgrip with a threaded attachment fastener. The hand guides each include a positioning flange that directs a golfer's hands along the overgrip length into a location appropriate for a particular type of shot. The overgrip is tapered from a minimum diameter at a proximal end of the overgrip to a maximum diameter at a distal end of the overgrip.

6 Claims, 2 Drawing Sheets

CONVERTIBLE GOLF CLUB

FIELD OF THE INVENTION

This invention is directed to golf clubs and, in particular, to a convertible golf club that helps golfers develop proper grip technique.

BACKGROUND OF THE INVENTION

Golf is a well-known sport in which a golf ball is advanced around a course using an assorted set of specialized clubs. Golfers strive to complete a given course using the fewest number of strokes. In golf, low scores are the goal.

Successful golfers typically master a wide variety of complementary skills to provide consistent results. Among the most important skills a golfer can develop is the ability to grip a golf club correctly. Without the proper gripping technique, a golfer may master other skills but perpetually achieve poor results. Hand placement is so critical that even slight oversights may ruin an otherwise perfectly-executed shot. Moreover, a golfer may vary the distance of a given shot merely by gripping the club at various distances from the end of the club. For example, relatively-short shots may be achieved merely by "choking up" on a club; that is, by gripping the club slightly closer than normal towards the club head. Proper grip technique is typically developed over a period of time through practice and discipline.

Many types of equipment have been developed to help golfers adopt a proper gripping technique. For example, some golf clubs include contoured grips. These clubs are typically used during training sessions and include valleys and protrusions around which a golfer wraps his fingers. These contoured clubs may guide some players, but have limited applicability. These clubs do not allow variable hand positioning and may not fit the hands of all golfers. Additionally, these clubs are typically not allowed during tournament play. The major governing body for golf in the United States, the USGA, prohibits the use of clubs that are molded for a particular part of the hands or that include "bulges" or "waists," as these clubs do. Those who train with contoured grip clubs often must expend additional money for non-contoured grip clubs to use during tournament play.

Other clubs seek to help golfers develop grip technique by providing a tapered grip that increases in thickness as a function of distance from the butt of the club. U.S. Pat. No. 3,837,647 provides an example of this type of club. These "reverse taper" clubs are designed to accommodate the spacing of fingers wrapped around a club. Although these clubs are ergonamically designed, they provide little guidance for players-in-training. These clubs may be comfortable, but they do not address the needs of novice golfers and do not appreciably accelerate grip technique development. Additionally, some of these clubs are not usable in tournament play; they include flared end portions and run afoul of the USGA waist and bulge guidelines.

What is needed is a golf club that includes the advantages of the prior art, while addressing the shortcomings thereof. The device should be a convertible golf club that is useable during tournament and non-tournament play. The club should have a hand placement guiding system that help golfers develop grip technique without limiting the versatility of the club. The club should guide a player's hands into various positions according to the type of shot required, without being uncomfortable to those with large or small hands. The club should also perform identically in both "training" and "tournament" modes.

SUMMARY OF THE INVENTION

The instant invention is a convertible golf club that helps golfers develop proper grip technique. The club employs an elongated shaft having a club head disposed at a shaft distal end and an overgrip disposed at a shaft proximal end. The overgrip is tapered and the overgrip thickness increases with distance from the proximal end of the overgrip. The club includes removable hand guides that direct a golfer's hands into preset positions along the length of the overgrip. Each guide places the golfer's hands at a distance from the end of the club that is appropriate for a given type of shot. One hand guide, for example, helps golfers train for short, "chip" shots by forcing the golfer's hand away from the butt end of the overgrip.

The hand guide is attached by a threaded fastener that passes through the hand guide and into an end plug mounted within the proximal end of the elongated shaft. Each hand guide and the end plug each include coaxially-aligned securing apertures that accommodate the attachment fastener. The attachment fastener cooperates with these securing apertures to removably secure the hand guides on the handgrip. The attachment fastener may be threaded into the end plug for storage while the hand guides are not in attached. By removing the hand guide, the club is useable during tournament play.

Thus, it is an object of the instant invention to provide a convertible golf club that is useable during tournament and non-tournament play.

It is a further object of the present invention to provide a golf club that employs a hand placement guiding system that helps golfers develop grip technique without limiting the versatility of the club.

It is an additional object of the present invention to provide a golf club that guides a player's hands into various positions according to the type of shot required, without being uncomfortable to those with large or small hands.

It is still a further object of the present invention to provide a golf club that performs identically in both "training" and "tournament" modes.

Other objects and advantages of this invention will become apparent from the following description taken in conjunction with the accompanying drawings wherein are set forth, by way of illustration and example, certain embodiments of this invention. The drawings constitute a part of this specification and include exemplary embodiments of the present invention and illustrate various objects and features thereof.

DETAILED DESCRIPTION OF THE PREFERRED EMBODIMENT

Figure 1:
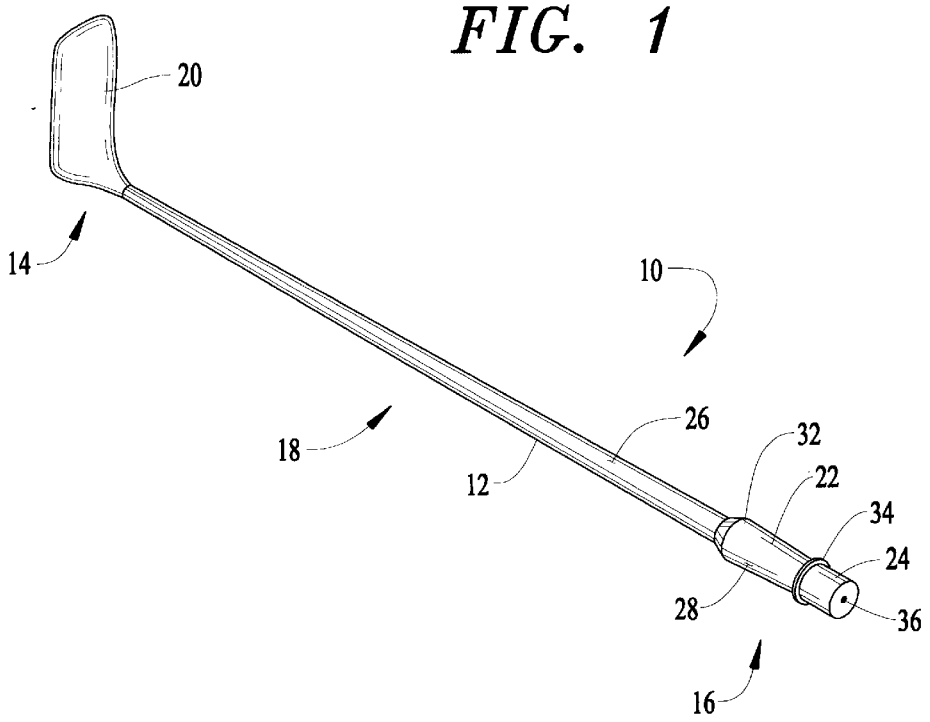
FIG. 1 is a pictorial view of the convertible golf club of the present invention.

It is to be understood that while a certain form of the invention is illustrated, it is not to be limited to the specific form or arrangement of parts herein described and shown. It will be apparent to those skilled in the art that various changes may be made without departing from the scope of the invention and the invention is not to be considered limited to what is shown in the drawings and described in the specification.

Now with respect to FIG. 1, a convertible golf club 10 according to the present invention is shown. By way of overview, the club 10 includes an elongated shaft 12 having a distal end 14 spaced apart from a proximal end 16 by a middle portion 18. A club head 20 is attached to the shaft distal end 14, and an overgrip 22 is mounted along the shaft proximal end 16. The overgrip 22 accommodates one of several removable hand guides 24,24'. Each of the hand guides 24,24' is sized and shaped to fit onto the proximal end 30 of the overgrip 22. Additionally, each guide 24,24' directs a golfer's hands into a preset position that is appropriate for a particular type of shot. One guide 24, for example, will force a golfer to "choke up" on the club 10, helping the golfer learn to effectively execute chip shots. After a given training session, the hand guide 24 may be removed, and the club 10 may be used during regulation USGA tournament play. The details of the club 10 will now be discussed.

Figure 2:
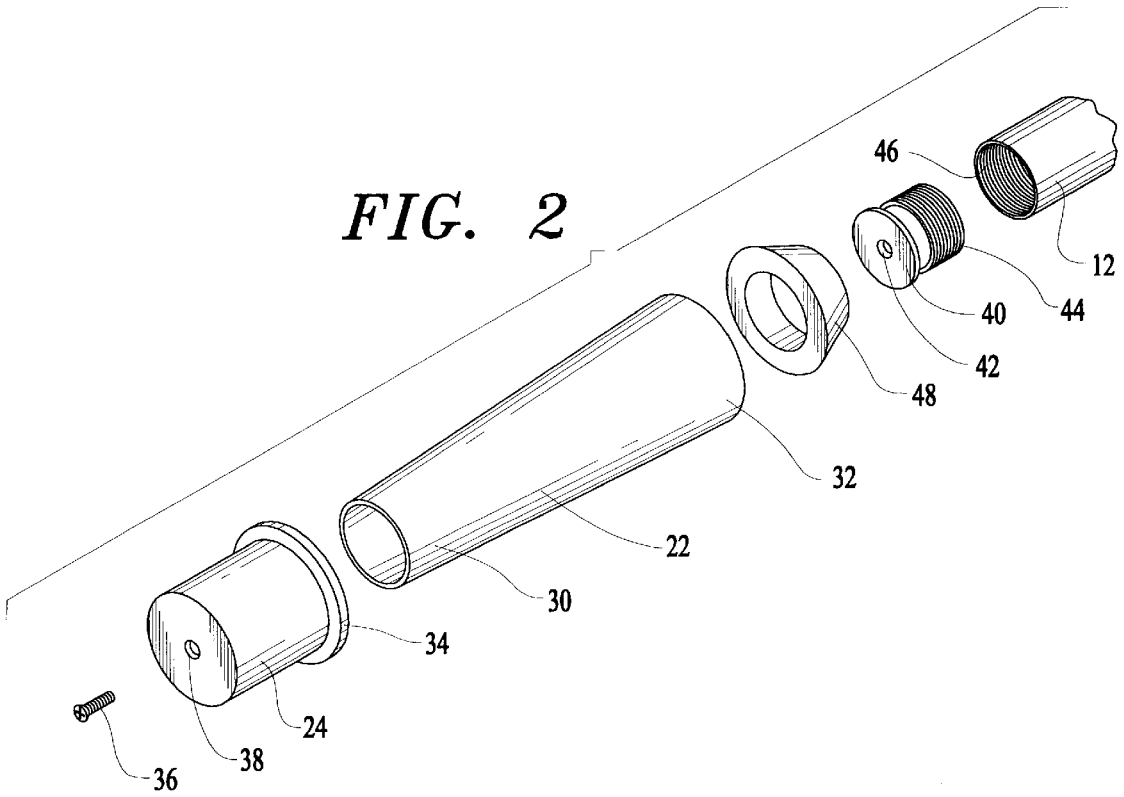
FIG. 2 is a cross section view of the proximal end of the golf club shown in FIG. 1.

As shown in FIG. 2, the overgrip 12 is essentially a frusto-conical sleeve that frictionally engages the outer surface 26 of the elongated shaft 12. The overgrip 22 has an outer surface 28 that tapers uniformly from a minimum diameter at an overgrip proximal end 30 to a maximum at an overgrip distal end 32. The slope of the overgrip outer surface 28 varies linearly from the proximal end 30 to the distal end 32. As a result, when a golfer holds the club 10, the first and second fingers encounter a relatively thicker portion of the overgrip 22 than the portion encountered by the third and fourth fingers. This taper produces an overgrip 22 that fits the natural finger curling of a golfer's hands. Furthermore, this geometry allows a golfer to hold the club 10 comfortably at any point along the overgrip 22.

Because the club 10 may be grasped securely at any point along the overgrip 22, a golfer may position his hands in a variety of shot-specific hand locations, without adversely grip integrity. A golfer may, for example, prepare for a short "chip shot" by positioning his hands towards the distal end 32 of the overgrip. With hands in this position, a golfer is said to be "choking up" on the club. Alternately, by positioning his hands towards the proximal end 30 of the overgrip 22, a golfer may prepare for a longer, "drive"-type shot. The overgrip 22 of the present invention advantageously allows a golfer to customize the performance of a given club 10 without altering grip technique; a golfer may grip the overgrip securely with the same relative finger positions anywhere along the overgrip. As a result, after successfully mastering one effective grip technique, a golfer may execute various shots by merely changing hand position along the length of the overgrip 22.

In the preferred embodiment, the overall length of the overgrip 22 is approximately ten-to-eleven inches. The overgrip maximum diameter is approximately two-to-three centimeters, and the minimum diameter is approximately one-and-one-half to two-and-one-half centimeters. Other sizes may be adopted if desired.

Figure 3:
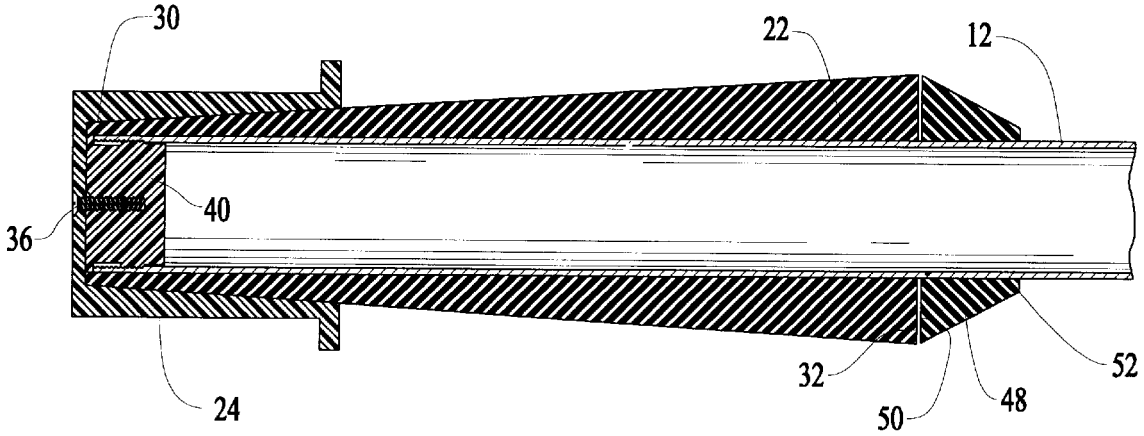
FIG. 3 is an exploded view of one embodiment of the hand guide of the present invention.
Figure 4:
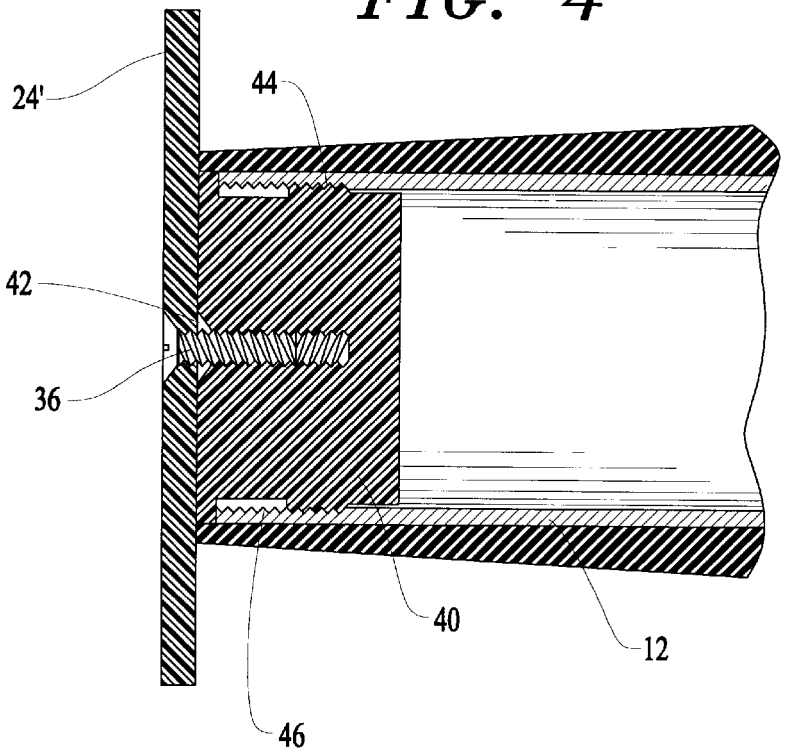
FIG. 4 is an exploded view of an alternate embodiment of the hand guide of the present invention.

The club 10 employs hand guides 24,24' that help a golfer learn appropriate hand positions for various shots. As seen in FIGS. 3 and 4, each hand guide 24,24' engages the proximal end 30 of the overgrip 22. A positioning flange 34,34' extends radially outward from each guide 24,24'. In the preferred embodiment, the flange 34,34' is a flat plate against which a golfer places the heel of his hand; other flange shapes, including fingers, may be used as needed.

As seen in FIGS. 3 and 4, the hand guide 24,24' is held in place by a threaded attachment fastener 36 that passes through a hand guide securing aperture 38 and into an end plug 40 mounted within the proximal end 16 of the elongated shaft 12. The end plug 40 includes a threaded securing aperture 42 that is coaxially aligned with the hand guide securing aperture 38. In turn, the securing apertures 38,42 lie along the central, longitudinal axis of the elongated shaft 12. The attachment fastener 36 is threaded and passes through the hand guide securing aperture 38 to engage the threaded securing aperture 42 of the end plug 40. With this arrangement, the attachment fastener 36 removably secures the hand guides 24,24' to the over grip 22. In the preferred embodiment, the elongated shaft 12 is hollow and the end plug 40 includes external threads 44 that engage internal threads 46 located inside the staff proximal end 16. The end plug 40 may also be secured with adhesive and may engage the outer surface 26 of the shaft 12. The hand guides 24,24' may also merely frictionally engage the overgrip 22.

In one embodiment, the hand guide 24 helps a golfer execute short, "chip" shots. As seen in FIG. 3, the positioning flange 34 is located approximately one-third of the distance from the overgrip proximal end 16 and the overgrip distal end 32. In this position, the hand guide flange 34 forces a golfer to choke up on the club 10. The positioning flange 34 acts like a bookend against which the golfer rests the heel of his secondary hand. Once a golfer is familiar with this "chip shot" hand location, the hand guide 24 may be removed. With the guide 24 removed, the club 10 can be used in tournament play and for all types of shots. The attachment fastener 36 may advantageously be threaded back into the end plug 40 for storage after the hand guide 24 has been removed.

In an alternate embodiment, the hand guide 24' lets a golfer execute longer shots. As seen in FIG. 4, the positioning flange 34' is located near the proximal end 30 of the overgrip 22. With the flange 34 guiding a golfer's hands into a suitable position along the length of the overgrip 22, the golfer is then free to focus on other details of hand placement. As a result, the hand guide 24' accelerates the development of proper grip technique. Once proper hand positioning is mastered, the guide 24' can be removed, and the club 10 may be used for all types of shots and during tournament play.

The club 10 may also include a tapered transition ring 48. The ring 48 extends longitudinally along the club shaft 12, beginning at the overgrip distal end 32. The transition ring 48 has a maximum diameter at a proximal end 50 and a minimum diameter at a distal end 52. With this shape, the transition ring 48 eases retrieval of clubs 10 that have been placed in a golf bag. The transition ring 48 may be a discrete item or may be formed integral with the distal end 32 of the overgrip 22. The transition ring 48 minimum diameter approximates the shaft 12 outer diameter and is in the range of one to one-and-one-half centimeters. The transition ring 48 maximum diameter is in the range between two to three centimeters. The distance between the transition ring ends 50,52 is approximately one-half to one centimeters.

Although the invention has been described in terms of a specific embodiment, it will be readily apparent to those skilled in this art that various modifications, rearrangements and substitutions can be made without departing from the spirit of the invention. The scope of the invention is defined by the claims appended hereto.

What is claimed is:

1. In a golf club having an elongated shaft with a proximal end having an overgrip mounted thereupon, and a distal end having a club head extending therefrom, the improvement comprising:

said overgrip being a frusto-conical sleeve having an outer diameter that tapers linearly from a minimum at an overgrip proximal end to a maximum at an overgrip distal end; and a hand guide releasably engaging said proximal end of said shaft, said hand guide having at least one radially-extending positioning flange, an end plug disposed within said shaft proximal end;

a first threaded securing aperture in said end plug;

a second securing aperture disposed within said hand guide, said first and second securing apertures being coaxially-aligned with a central longitudinal axis of said shaft; and a threaded attachment fastener constructed and arranged to pass through said second securing aperture and engage said first securing aperture, whereby said attachment fastener releasable secures said hand guide to said proximal end of said shaft and said hand guide cooperates with said overgrip to direct a golfer's hands into a predetermined orientation.

2. The golf club of claim 1, wherein said positioning flange is substantially parallel to said proximal end of said overgrip.

3. The golf club of claim 1, wherein said positioning flange is substantially parallel to a plane bisecting the length of said overgrip, whereby said hand guide directs the hands of a golfer into an orientation appropriate for a chip shot.

4. The golf club of claim 1, wherein said club includes a transition ring extending from said overgrip distal end, said transition ring having an outer diameter that tapers from a maximum at a proximal end of said transition ring to a minimum at a distal end thereof, said transition ring maximum outer diameter being substantially equal to said overgrip maximum outer diameter, said transition ring minimum outer diameter being substantially equal to an outer diameter of said shaft.

5. The golf club of claim 4, wherein said positioning flange is substantially co-planar to said proximal end of said overgrip.

6. The golf club of claim 4, wherein said positioning flange is substantially parallel to a plane bisecting the length of said overgrip, whereby said hand guide directs the hands of a golfer into an orientation appropriate for a chip shot.

* * * * *